US005125464A

United States Patent [19]

Sabatier

[11] Patent Number: 5,125,464

[45] Date of Patent: Jun. 30, 1992

[54] DRILLING DEVICE FOR THE STUDY AND EXPLOITATION OF THE SUBSOIL

[75] Inventor: Gérard Sabatier, Limoges, France

[73] Assignee: Cogema, Velizy-Villacoublay, France

[21] Appl. No.: 487,997

[22] PCT Filed: Jul. 24, 1989

[86] PCT No.: PCT/FR88/00388

§ 371 Date: May 10, 1990

§ 102(e) Date: May 10, 1990

[87] PCT Pub. No.: WO90/01102

PCT Pub. Date: Feb. 8, 1990

[30] Foreign Application Priority Data

Jul. 28, 1988 [FR] France ..... 88 10457

[51] Int. Cl.[5] ..... E21B 6/00; E21B 21/14

[52] U.S. Cl. ..... 175/135; 175/171; 175/173; 175/213; 175/215; 175/320; 175/324

[58] Field of Search ..... 175/171, 173, 113, 135, 175/213, 214, 215, 211, 320, 324, 65; 173/78, 79, 80, 104, 105

[56] References Cited

U.S. PATENT DOCUMENTS

| | | | |
|---|---|---|---|
| 1,123,129 | 12/1914 | Kirkpatrick | 173/78 |
| 3,077,358 | 2/1963 | Costa | 175/324 X |
| 3,117,636 | 1/1964 | Wilcox et al. | 175/171 X |
| 3,155,179 | 11/1964 | Hunt et al. | 175/215 |
| 3,208,538 | 9/1965 | Pitcher | 175/215 X |
| 3,227,230 | 1/1966 | Lagerstrom | 175/214 |
| 3,419,092 | 12/1968 | Elenburg | 175/215 X |
| 3,552,507 | 9/1971 | Brown | 175/258 |
| 4,494,613 | 1/1985 | Tamaki et al. | 173/105 X |
| 4,682,661 | 7/1987 | Hughes et al. | 175/324 X |

FOREIGN PATENT DOCUMENTS

| | | | |
|---|---|---|---|
| 933146 | 9/1973 | Canada . | |
| 958696 | 12/1974 | Canada | 175/65 |
| 28121 | 5/1981 | European Pat. Off. . | |
| 2924393 | 12/1980 | Fed. Rep. of Germany | 175/257 |
| 3249566 | 7/1984 | Fed. Rep. of Germany . | |
| 3728269 | 9/1988 | Fed. Rep. of Germany . | |
| 422681 | 4/1967 | Switzerland . | |
| 959955 | 6/1964 | United Kingdom . | |
| 2041039 | 9/1980 | United Kingdom | 175/215 |

*Primary Examiner*—Hoang C. Dang
*Attorney, Agent, or Firm*—Basile and Hanlon

[57] ABSTRACT

The invention relates to the drilling of a hole for the study of the underground. The roto-percussion head acts on the drilling tube of which the base carries a cutter. The cutter is integral with the sleeve inside which drilling water is injected. The water and the rock debris go up and out through the evacuation opening. Application to the reverse flow drilling allowing to extract at the evacuation opening cores or rock debris which go up inside the axial tube as soon as they are taken without any risk of being contaminated by the previously traversed layers of ground.

10 Claims, 6 Drawing Sheets

DRILLING DEVICE FOR THE STUDY AND EXPLOITATION OF THE SUBSOIL

BACKGROUND OF THE INVENTION

1. Field of the Invention

The present invention pertains to the novel application of a particular circulation technique to an existing drilling method. The drilling method is percussion drilling with the hammer outside the hole. The circulation technique is double tube reverse circulation. This technique has already been used in drillings, but heretofore only in totally different fields, for instance, in tricone drilling.

2. Description of the Relevant Art

Soil drilling by means of a cutter screwed onto the lower extremity of a tube whose top end is subjected simultaneously to percussion and rotation transmitted through a suface hammer, has been known for a long time.

As drilling progresses, tubular elements are screwed on the top end of the tube, which tubular elements are again subjected to the action of the drilling mechanism. The tube is used to inject a fluid such as air or water. The role of the fluid is to clean the cutter, free the rock debris from the bottom of the hole and bring it back up to the surface via the annular space created between the tube and the ground.

This method presents two main disadvantages. First, the fluid loaded with the excavational debris can be contaminated by other debris torn away from the wall during raising, preventing the reconstruction of the successive layers penetrated. Second, the collars used to assemble together the tubular elements protruding into the drill-hole contribute to the degradation of the wall and create a permanent risk of jamming.

The aim of the present invention is to circumvent these disadvantages and to achieve drill-holes of better quality, as well as to make "drilling with hammer outside the hole" an actual tool of geological exploration by producing a good sampling of the layers penetrated. It is a further aim to achieve these goals at a lesser cost than conventional core-sampling.

SUMMARY OF THE INVENTION

The process according to the invention for achieving reverse circulation percussion drilling with hammer outside the hole is characterized in that water is injected between a sleeve and a concentric tube progressing simultaneously.

The water arriving at the base comes out around the cutter, cleans up the bottom of the drill-hole, then, via the central hole of the cutter and the inside of the tube, comes back up to the surface with the rock debris.

Because of this novel application of the process, the rock debris comes back up as soon as it is dislodged, thereby preventing any contamination of the sample during raising. The debris also comes up very rapidly due to the small tube internal cross section. Further, the rock debris is not recrushed along the drill-hole by the collars, thus permitting the production of rock elements of a size which faciliatates their identification and their study.

A drilling device according to the invention for the operation of the process is comprised of an axial tube whose top end is truck by a hammer and whose internal cavity is used for the raising of the debris which is ejected at the surface.

According to a characteristic of the invention, this debris is ejected at the surface either in the axis of the hammer, via a needle which penetrates the piston, or laterally below the hammer.

The drilling device is characterized in that an annular space is enclosed around the axial tube by a sleeve. The annular space is connected, below the hammer, to a water injection head and, at the base of the hole, to the cutter itself.

According to whether or not it is required to provide the geologist with a lined drill-hole, two different devices will be used.

If the hole is to be delivered bare, one will use a stack of double-bodied solid cast elements comprised of an axial tube and of a peripheral sleeve, male threaded at one end and female threaded at the other end, these threads being used to couple the double-bodied solid cast elements, and to drive their rotatory motion. The tube is centered within the sleeve by means of a device which protects the sleeve from the waveshocks transmitted by the tube and which enables a certain degree of sliding between tube and sleeve.

If the hole is to be lined, it is preferable to use the other device. The axial tube will be comprised of conventional tubular extensions, male threaded at both extremities and assembled together with collars. The peripheral sleeve will be comprised of elements that are male threaded at one end, female threaded at the other end, and screwed one into the other. In contrast to the double-bodied solid cast device, the axial tube and the peripheral sleeve are only linked to one another at their extremities, below the hammer and at the cutter.

According to a characteristic of the invention, besides the strike action which is, in all cases, transmitted by the tube to the cutter, the rotational driving of the cutter may be achieved in two ways, either through the hammer acting onto the tube, or through an independent rotary head acting on the sleeve.

The sleeve which is, in all cases, advancing with the cutter, can accompany it in two ways, either by not rotating, or by being rotated either under the action of the rotary head or via a device linked to the cutter.

In the latter case, the threads of the elements of the tube and those of the elements of the sleeve will have to be made in the opposite direction.

According to another characteristic of the invention, the hammer has a tubular piston through which runs a hollow "needle" whose internal diameter is identical to that of the axial tube, thus resulting in a rigorously rectilinear trajectory for the rock debris raised by the water, so much so that it can be recovered at the outlet of the tube above the hammer. This particular configuration permits, subject to minor modifications to the cutter, the continuous raising of core-samples, thus further improving the quality of the sampling of the strata penetrated.

BRIEF DESCRIPTION OF THE DRAWINGS

Other objects and features of the invention will become apparent by reference to the following specifications and to the drawings, in which.

DETAILED DESCRIPTION OF THE PREFERRED EMBODIMENTS

Figure 1:
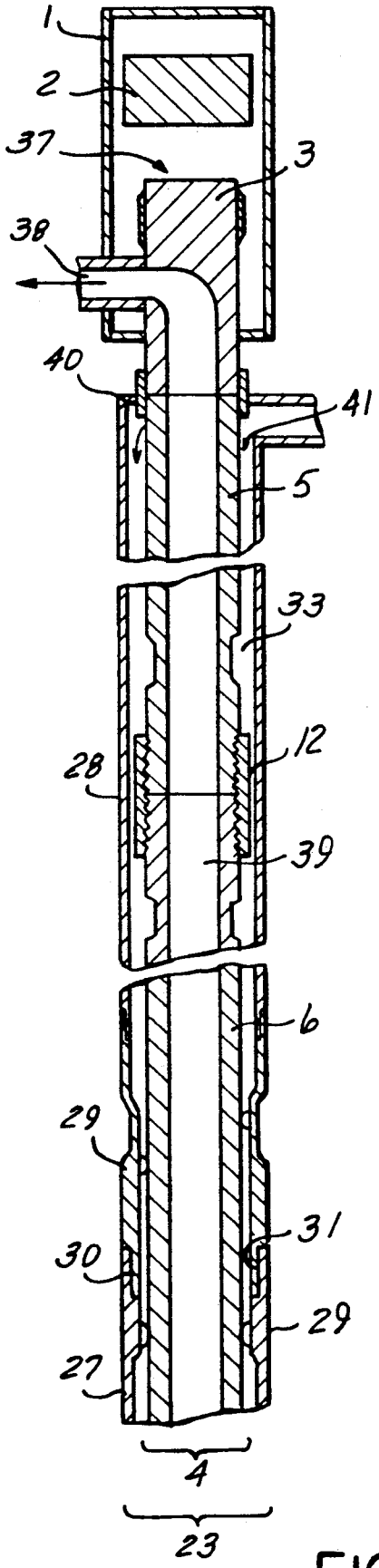
FIG. 1 is a schematic longitudinal section showing the upper part of a drilling rig in accordance with the invention.
Figure 2:
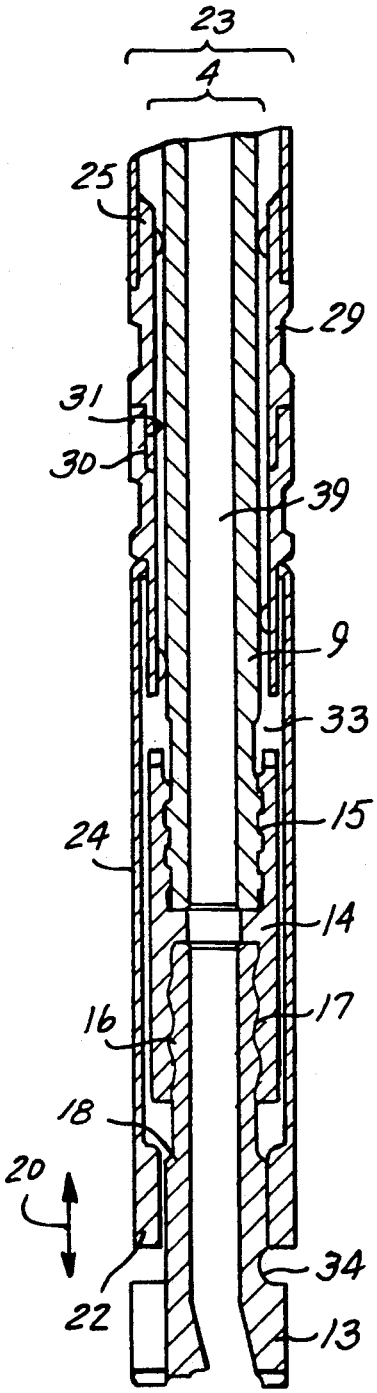
FIG. 2 shows the lower part at the level of the cutter.
Figure 4:
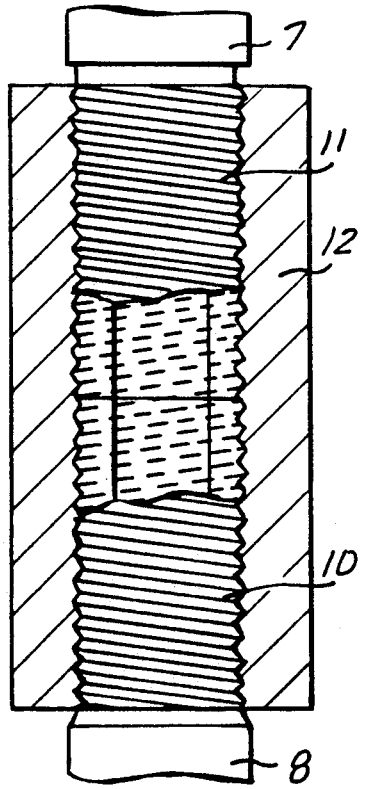
FIG. 4 illustrates the junction zone between two elements of the central tube.
Figure 5:
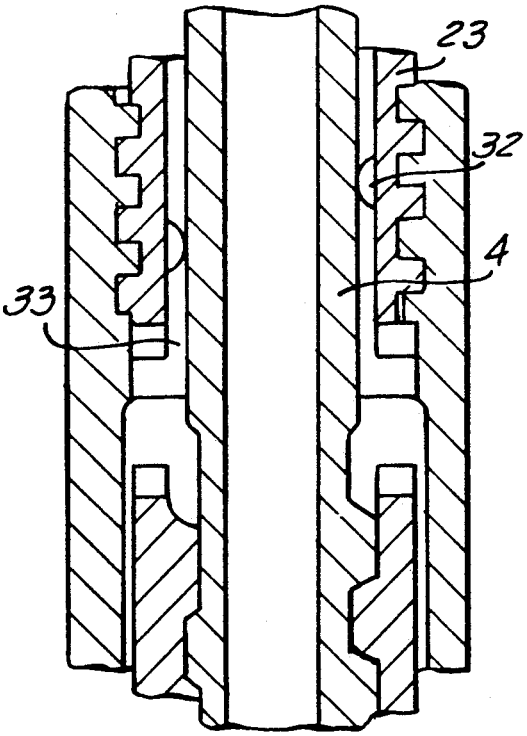
FIG. 5 is a view of the base of the axial tube and of the first element of the surrounding sleeve.
Figure 6:
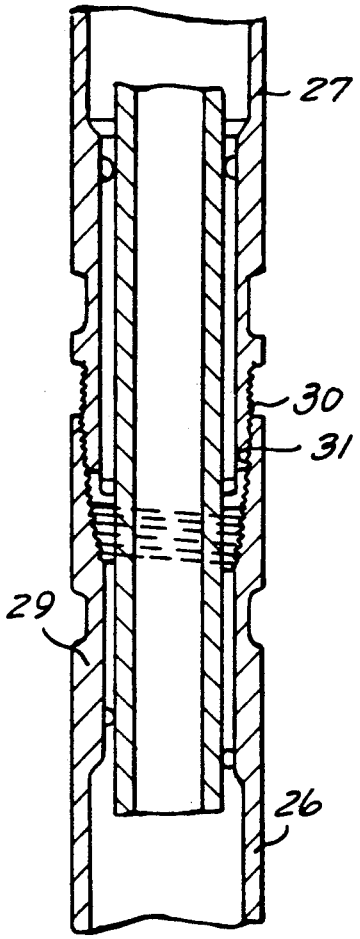
FIG. 6 illustrates unscrewing between two elements of the surrounding sleeve.
Figure 13:
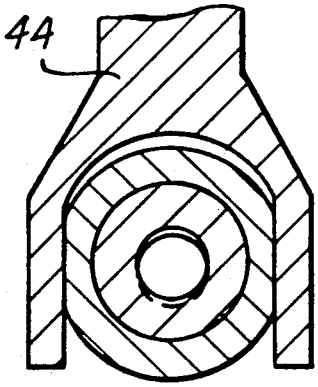
FIG. 13 is a cross section along line XIII—XIII in FIG. 12 showing a jam releasing key.

A reverse flux drilling device according to the invention has been schematically represented in FIGS. 1 and 2. The roto-percussion head or hammer 1 is comprised of a piston 2 which hammers, in a known manner, onto the upper part 3 of a tube 4. The latter is comprised of a series of tubular extensions such as 5–9, assembled one to another in series. To this end, each extension has at its upper end a threaded length 10, as shown in FIG. 4, and at its base another threaded length 11. Both threads are in the same direction, and assembling is achieved in a known manner by the screwing of two adjacent threaded lengths 10 and 11 within a threaded collar 12.

At its lower extremity, the tube (comprised of tubular extensions) is screwed onto the cutter 13 by means of a threaded collar 14. This collar 14 is characterized by the fact that its thread, on the side opposite to the cutter, is easier to unscrew than those of the above mentioned zones 10 and 11. This allows the following results. A thread 15 of trapezoidal profile is provided in the upper part of collar 14. Thread 15 is able to be assembled with the lower tubular extension 9 of tube 4. A thread 17 of the rope type, for example of the kind classified under reference R 45 in the European standard (see FIGS. 2 and 7), is provided in the lower part of collar 14. Thread 17 is able to be assembled with thread 16 of cutter 13.

In addition, between the shoulder per se of the cutter 13 and its male thread 16, a length 18 equipped with longitudinal protrusions 19 is provided for on the body. The latter slide freely in the axial direction (double arrow 20, FIG. 2) between the corresponding grooves 21 provided for on the inside of the extremity 22 of the lower element 24 of a sleeve 23 formed by the screwing, one into the others, of elements such as 24–28. These sleeve elements 24 to 28 are assembled to one another along their length by male and female threads 30 and 31, respectively, cut in reinforced zones 29. The latter threads are characterized by a direction opposite to that of threads 10, 11, 15, 17. In other words, some have a "right hand" thread while the others have a "left hand" thread. Thus, when the head 1 drives drilling tube 4 by its upper end, it is the lower part of the latter that leads the base of sleeve 23 in rotation through protrusions and grooves 19, 21. Because of this arrangement, the rotation driven by head 1 tends to tighten all screwed assemblings, those of tube 4 as well as those of sleeve 23.

In addition, centering pieces 32 are provided for on the internal wall of sleeve 23, distributed within reinforced zones 29 and optionally within sleeve elements 24 to 28. These pieces are destined to rest against the outside of tube 4, to create around it an intermediate annular space 33 where the drilling fluid such as air or water will circulate.

Figure 7:
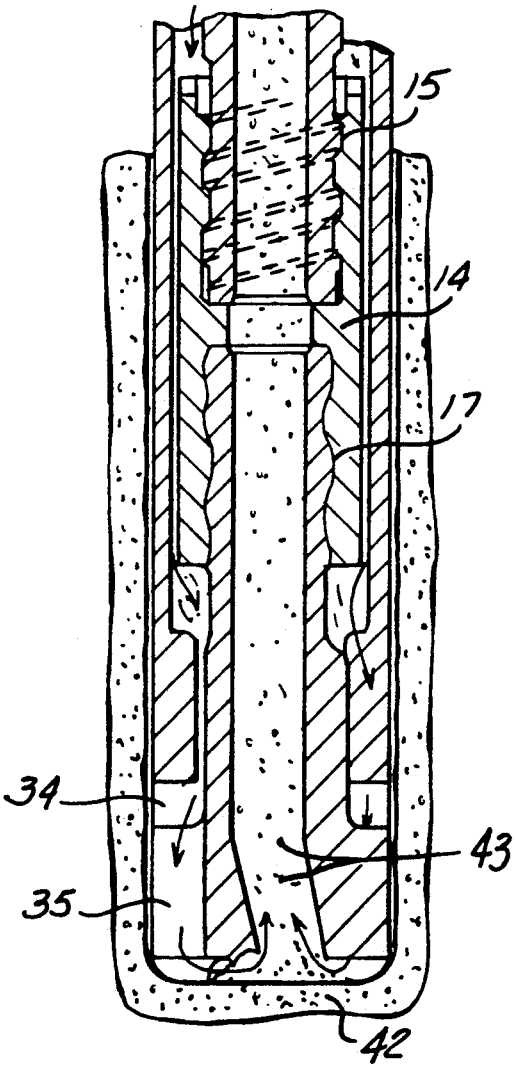
FIG. 7 illustrates the lower structure, within the cutter area.
Figure 8:
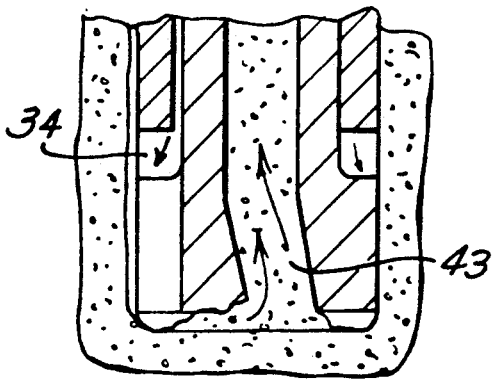
FIG. 8 shows the circulation of water and of the sediments within the cutter area.
Figure 9:
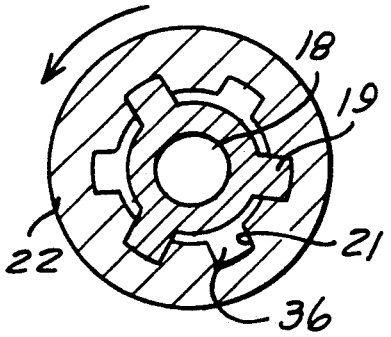
FIG. 9 is a section along line IX—IX in FIG. 10.
Figure 10:
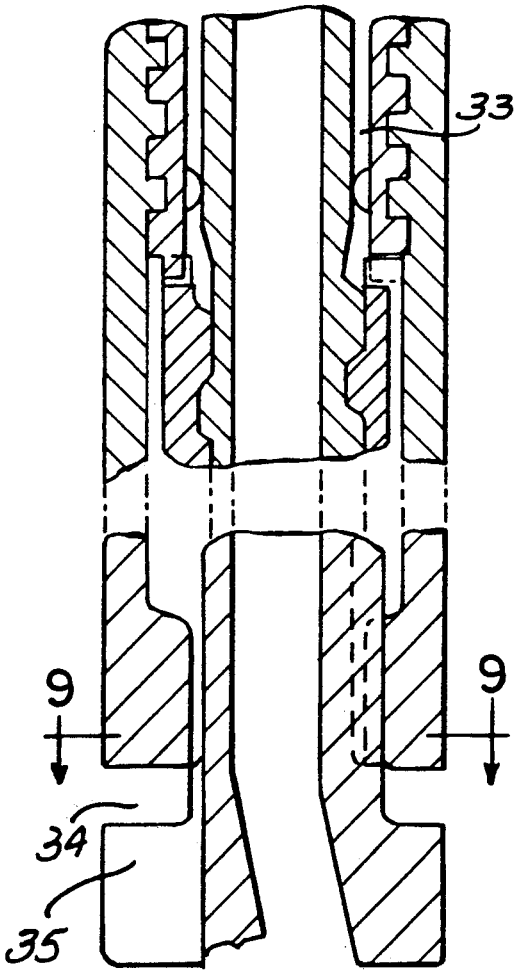
FIG. 10 shows the junction between the cutter and the base of the axial tube and that of the surrounding sleeve.

Finally, to increase the area for drilling fluid flow, one preferably provides for a large peripheral groove 34 and for longitudinal milled channels 35 onto trepan 13, as shown in FIGS. 2, 7, 10. One also provides for the number of male grooves 19 to be less than that of grooves 21 of the collar 22, consequently leaving large water or air passages 36 free. In the preferred embodiment, as shown in FIG. 9, there are three male grooves 19, six collar grooves 21, and three free water or air passages 36.

In the example of FIG. 1, the upper section 3 of drilling tube 4 is roped by a striking surface 37 and it has a lateral outlet 38 which communicates with the internal space 39 of the drilling tube 4. Furthermore, the annular space 33 is closed in its upper part by an impervious injection drum 40 which surrounds tube 4 but remains isolated from the impact of piston 2, while this space 33 opens laterally into a feeding channel 41 connected to a compressed air or pressurized water injection system.

The device operates in the following manner. Axial tube 4 is used to transmit the shock waves and the rotary movement to cutter 13. The fluid such as air or water injected via feeding channel 41 descends down the annular space 33. Then, via passages 36, 34, 35, the fluid reaches the excavation zone 42 located at the bottom of the hole, which it cleans, and from which it evacuates the debris 43. The latter is brought back up via the central space 39, then ejected via opening 38. Thus, there is no risk for the rock debris that is brought up to be contaminated by the soil layers already penetrated.

Figure 11:
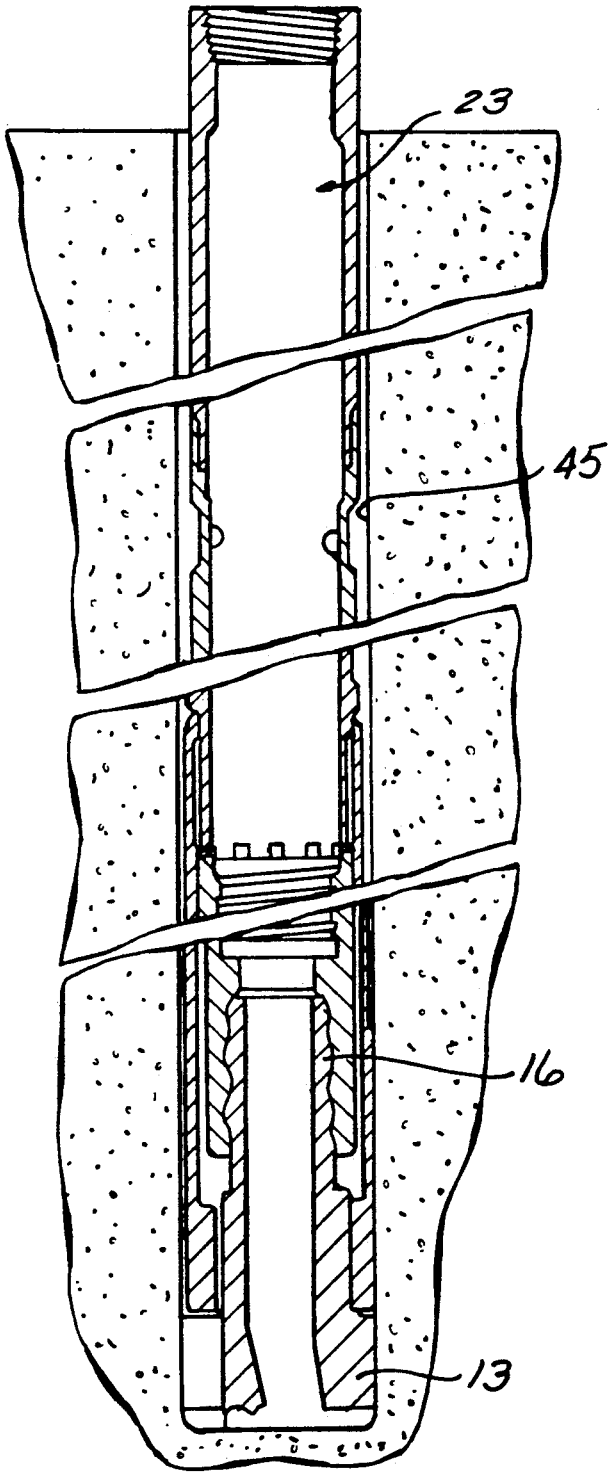
FIG. 11 shows the finished drill-hole, such as delivered lined.
Figure 12:
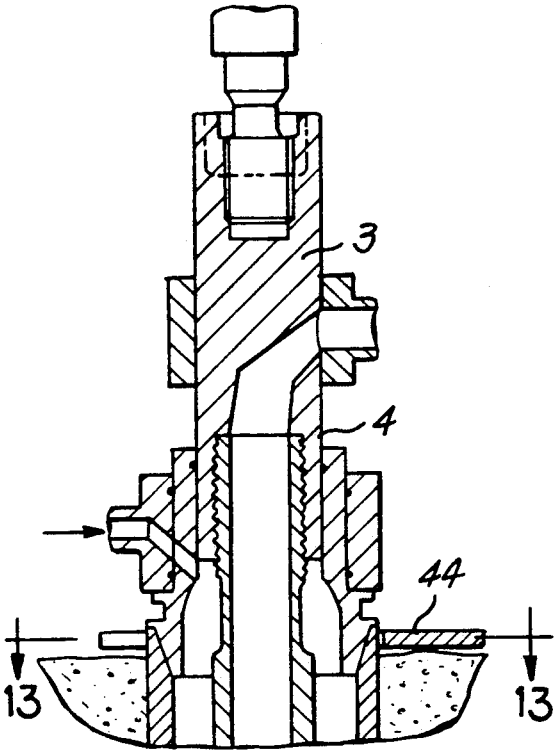
FIG. 12 details a possible structure within the upper section of FIG. 1, in "drilling" position.
Figure 15:
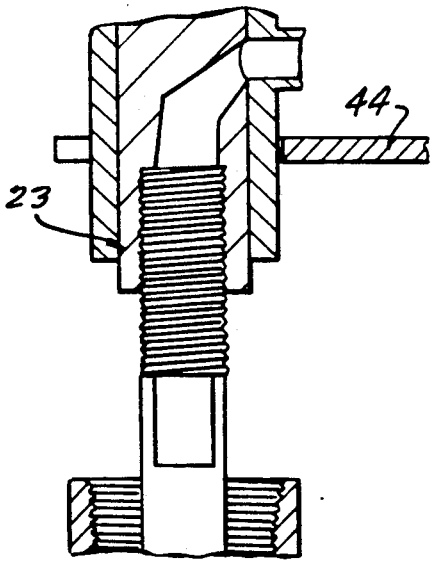

As shown in FIGS. 12 and 15, at the end of the drilling, it suffices to block the top end of sleeve 23 with a key 44, then to induce the rotation of tube 4 in the direction opposite to that used for drilling. It is at the level of collar 14 that the threads loosen and unscrew, so that sleeve 23 and trepan 13 remain in position within the hole 45 when tube 4 is removed, as seen in FIG. 11. Thus, the hole can be delivered lined.

Figure 3:
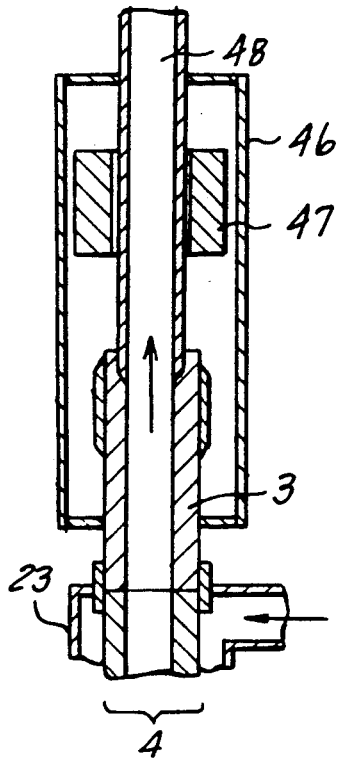
FIG. 3 shows a variant of FIG. 1, permitting the additional recovery of core samples above the hammer.

In the variant of FIG. 3, a piston 47 is provided for within the hammer 46; piston 47 presenting the particularity of being pierced. This annular piston is pierced by a tubular needle 48 which extends tube 4 towards the top. The importance of this arrangement is to evacuate sediments 43 along a trajectory that is completely rectilinear to the final evacuation opening 48. Because of this structure, it is possible to recover from upper opening 48 not only rock debris, but also core-samples permitting a more complete study of the strata.

Figure 14:
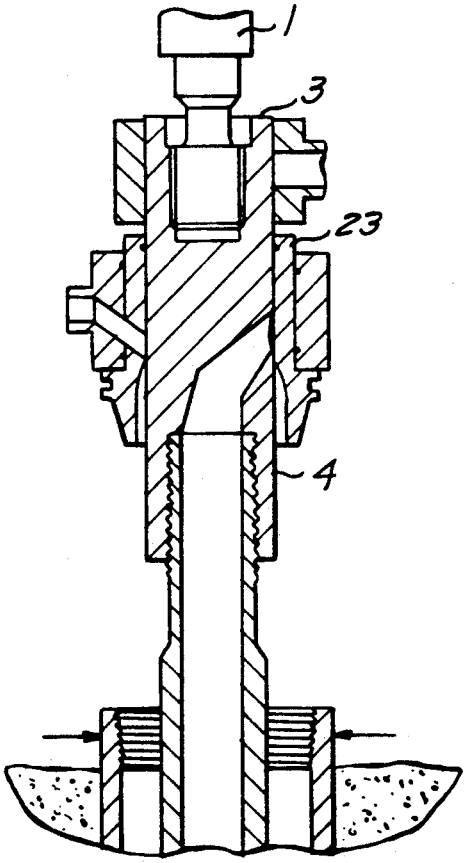
FIGS. 14 and 15 correspond to another view of FIG. 12, in "operating" position.

A possible mode of achievement of the head device connecting tube 4, sleeve 23 and hammer 1 according to FIGS. 1 and 2 has been represented in FIGS. 12, 14.

While certain embodiments of the present invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A drilling device for achieving reverse circulation percussion drilling, the drilling device comprising:

an axial drilling tube having a top and a bottom;

a hammer having a piston, the piston being in striking contact with the drilling tube top;

means for rotating the hammer, wherein the rotary movement of the hammer also acts upon the drilling tube top;

a peripheral lining sleeve surrounding the tube, the sleeve having an upper portion and a lower portion;

a free annular space extending between the lining sleeve and the tube;

a fluid injection head connected to the sleeve upper portion, wherein the axial tube protrudes above the injection head;

an opening, located adjacent the top of the drilling tube, for evacuating drilling debris brought up by circulating drilling fluid; and longitudinal internal grooves formed in the sleeve lower portion, the internal grooves in sliding engagement with protrusions distributed in a lesser number around a cutter body, thereby leaving a plurality of channels free between the sleeve lower portion and the cutter body, wherein the drilling fluid flows through the channels.

2. The drilling device as defined in claim 1 wherein the axial drilling tube further has a central cavity and wherein the drilling debris brought up by the circulating drilling fluid is evacuated through the drilling tube central cavity.

3. The drilling device as defined in claim 2, further comprising a cutter having an internal cavity and mounted to the axial drilling tube bottom, wherein the circulating drilling fluid flows around the cutter, and then it comes back up with rock debris through the internal cavity of the cutter, and then via the central cavity of the tube, and wherein the cutter is adapted to produce a fluid circulation top hammer drilling hole.

4. The drilling device as defined in claim 3, further comprising:

a stack of double-bodied cast elements, comprised of the axial tube transmitting the striking action and of the peripheral sleeve; and means for coupling and driving rotary motion of the stack, the coupling and driving means comprising male and female threads, the male threads being at one end of the sleeve, the female threads being at the other end of the sleeve;

the drilling device thereby being adapted to achieve a drilling hole to be delivered bare.

5. The drilling device as defined in claim 1, wherein each of the drilling tube and sleeve is comprised of a plurality of tubular extensions threadingly engageable with one another, by means of threads of a given direction for the axial tube and by means of threads of an opposite direction for the sleeve.

6. The drilling device as defined in claim 5, further comprising a driving connection between the axial tube and the peripheral sleeve, the driving connection being located at the bottom of a drill-hole, within a cutter zone.

7. The drilling device as defined in claim 4 wherein the sleeve has a top end, the drilling device further comprising:

means for blocking the sleeve top end while rotating the tube;

means for driving the tube in inverse rotation at the end of a drilling operation;

means for disengaging the tube and the sleeve; and means for raising the axial tube while leaving the sleeve in position such that it lines the internal wall of the drilling hole.

8. The drilling device as defined in claim 1, wherein the piston has an axial through bore, and wherein the drilling device further comprises:

a tubular needle having a top, the needle extending through the through bore, and in fluid communication with the top of the axial drilling tube, wherein the evacuation opening is located on the top of the needle, thereby providing the debris with a rigorously rectilinear trajectory from a cutter located at the bottom of the drilling tube, wherein it is possible to recover unbroken core-samples, brought up by the drilling fluid to the top of the tube.

9. The drilling device as defined in claim 1 wherein the sleeve has an internal wall, and wherein the device further comprises:

spacing pieces protruding from the internal wall, and abutting against the axial tube so as to define a rigorous annular intermediate space.

10. The drilling device as defined in claim 3, wherein the axial tube is comprised of conventional tubular extensions, male threaded at both extremities and assembled together with collars, and wherein the sleeve is formed of thin tubular extensions which are male threaded at one end and female threaded at the other end, the drilling device thereby being adapted to achieve a drilling hole to be delivered lined.

* * * * *

UNITED STATES PATENT AND TRADEMARK OFFICE

CERTIFICATE OF CORRECTION

PATENT NO. : 5,125,464

DATED : June 30, 1992

INVENTOR(S) : Gerard Sabatier

It is certified that error appears in the above-identified patent and that said Letters Patent is hereby corrected as shown below:

On the Title Page, after " [86] PCT No.:", please delete "PCT/FR88/00388" and insert --PCT/FR89/00388--.

Signed and Sealed this

Seventeenth Day of August, 1993

Bruce Lehman

*Attest:*

BRUCE LEHMAN

*Attesting Officer*

*Commissioner of Patents and Trademarks*